US009597257B2

(12) United States Patent
Halperin

(10) Patent No.: US 9,597,257 B2
(45) Date of Patent: Mar. 21, 2017

(54) AUTOMATED CHEST COMPRESSION APPARATUS

(71) Applicant: Johns Hopkins University, Baltimore, MD (US)

(72) Inventor: Henry R. Halperin, Baltimore, MD (US)

(73) Assignee: The Johns Hopkins University, Baltimore, MD (US)

( * ) Notice: Subject to any disclaimer, the term of this patent is extended or adjusted under 35 U.S.C. 154(b) by 0 days.

(21) Appl. No.: 14/614,190

(22) Filed: Feb. 4, 2015

(65) Prior Publication Data

US 2015/0148717 A1 May 28, 2015

Related U.S. Application Data

(63) Continuation of application No. 12/423,632, filed on Apr. 14, 2009, now abandoned, which is a (Continued)

(51) Int. Cl.

| | |
|---|---|
| ***A61H 9/00*** | (2006.01) |
| ***A61H 11/00*** | (2006.01) |
| ***A61H 31/00*** | (2006.01) |

(52) U.S. Cl.

CPC ..... *A61H 31/006* (2013.01); *A61H 9/0078* (2013.01); *A61H 2011/005* (2013.01); (Continued)

(58) Field of Classification Search

CPC ..... A61H 11/00; A61H 11/02; A61H 31/00; A61H 31/004; A61H 31/005; (Continued)

(56) References Cited

U.S. PATENT DOCUMENTS 2,486,667 A * 11/1949 Meister ..... 601/41
3,042,024 A * 7/1962 Mendelson ..... 601/44
(Continued)

*Primary Examiner* — Valerie L Woodward
(74) *Attorney, Agent, or Firm* — K. David Crockett, Esq.; Paul J. Backofen, Esq.; Crockett & Crockett, PC

(57) ABSTRACT

A system applies cardiopulmonary resuscitation (CPR) to a recipient. An automated controller is provided together with a compression device which periodically applies a force to a recipient's thorax under control of the automated controller. A band is adapted to be placed around a portion of the torso of the recipient corresponding to the recipient's thorax. A driver mechanism shortens and lengthens the circumference of the band. By shortening the circumference of the band, radial forces are created acting on at least lateral and anterior portions of the thorax. A translating mechanism may be provided for translating the radial forces to increase the concentration of anterior radial forces acting on the anterior portion of the thorax. The driver mechanism may comprise a tension device for applying a circumference tensile force to the band. The driver mechanism may comprise an electric motor, a pneumatic linear actuator, or a contracting mechanism defining certain portions of the circumference of the band. The contracting mechanism may comprise plural fluid-receiving cells linked together along the circumference of the band. The width of each of the fluid-receiving cells becomes smaller as each cell is filled with a fluid. This causes the contraction of the band and a resulting shortening of the circumference of the band.

9 Claims, 7 Drawing Sheets

Related U.S. Application Data continuation of application No. 11/448,371, filed on Jun. 6, 2006, now Pat. No. 7,517,325, which is a continuation of application No. 09/954,544, filed on Sep. 12, 2001, now Pat. No. 7,056,295, which is a continuation of application No. 09/188,065, filed on Nov. 9, 1998, now abandoned.

(52) U.S. Cl.
CPC ..... *A61H 2031/003* (2013.01); *A61H 2201/1238* (2013.01); *A61H 2201/5007* (2013.01); *Y10S 601/06* (2013.01)

(58) Field of Classification Search
CPC ..... A61H 31/006; A61H 2011/005; A61H 2031/00; A61H 2031/001; A61H 2031/002; A61H 2031/003; A61H 9/0078–9/0092
See application file for complete search history.

(56) References Cited

U.S. PATENT DOCUMENTS

| | | | | | |
|---|---|---|---|---|---|
| 4,257,407 | A | * | 3/1981 | Macchi | 601/44 |
| 4,424,806 | A | * | 1/1984 | Newman et al. | 601/41 |
| 4,928,674 | A | * | 5/1990 | Halperin et al. | 601/44 |
| 5,490,820 | A | * | 2/1996 | Schock et al. | 601/41 |
| 5,575,807 | A | * | 11/1996 | Faller | 607/5 |
| 5,769,800 | A | * | 6/1998 | Gelfand et al. | 601/151 |
| 6,066,106 | A | * | 5/2000 | Sherman et al. | 601/41 |

* cited by examiner

AUTOMATED CHEST COMPRESSION APPARATUS

This application is a continuation of U.S. patent application Ser. No. 12/423,632, filed Apr. 14, 2009, which is a continuation of U.S. patent application Ser. No. 11/448,371, filed Jun. 6, 2006, now U.S. Pat. No. 7,517,325, which is a continuation of U.S. patent application Ser. No. 09/954,544, filed Sep. 12, 2001, now U.S. Pat. No. 7,056,295, which is a continuation of U.S. application Ser. No. 09/188,065 filed Nov. 9, 1998, now abandoned.

BACKGROUND OF THE INVENTION

1. Field of the Invention

The present invention relates to an automated chest compression apparatus for the automated administration of CPR.

2. Description of the Related Art

Each year there are more than 300,000 victims of cardiac arrest. Conventional CPR techniques, introduced in 1960, have had limited success both inside and outside of the hospital, with only about a 15% survival rate. Accordingly the importance of improving resuscitation techniques cannot be overestimated. In the majority of cardiac arrests, the arrest is due to ventricular fibrillation, which causes the heart to immediately stop pumping blood. To treat ventricular fibrillation, defibrillation is administered which involves the delivery of a high energy electric shock to the thorax to depolarize the myocardium, and to allow a perfusing rhythm to restart. If, however, more than a few minutes pass between the onset of ventricular fibrillation and the delivery of the first defibrillation shock, the heart may be so deprived of metabolic substrates that defibrillation is unsuccessful.

The role of CPR is to restore the flow of oxygenated blood to the heart, which may allow defibrillation to occur. A further role of CPR is to restore the flow of oxygenated blood to the brain, which may prevent brain damage until their heart can be restarted. Thus, CPR is critical in the treatment of a large number of patients who fail initial defibrillation, or who are not candidates for defibrillation.

Various studies show a strong correlation between restarting the heart and higher levels of coronary blood flow. To restart the heart, if initial defibrillation fails (or is not indicated), coronary flow must be provided. With well-performed CPR, together with the use of epinephrine, brain blood flow probably reaches 30-50% of normal. Myocardial blood flow is much more limited, however, in the range of 5-20% of normal. Heart restarting has been shown to correlate with the pressure gradient between the aorta and the right atrium, obtained between compressions (i.e., the coronary perfusion pressure). CPR, when applied correctly, is designed to provide a sufficient amount of coronary perfusion pressure by applying a sufficient amount of chest compression force.

U.S. Pat. No. 4,928,674 (to Halperin et al.) discloses a process of pneumatic vest CPR aimed at elucidating the mechanisms of blood flow during resuscitation. Previous writings hypothesized that blood flowed simply due to the mechanical compression of the heart. However, subsequent studies have indicated that blood movement as a result of CPR can be correlated more accurately to a general rise in intra-thoracic pressure, transmitted to the intra-thoracic vasculature. Whereas the retrograde flow of blood is prevented by cardiac and venous valves, this will cause peripheral arterial-venous pressure gradients to be produced, resulting in an antegrade flow of blood from the thorax into the peripheral arterial system. When chest compression is released, this intra-thoracic pressure falls, returning the venous blood from the periphery into the thoracic venous system. Pneumatic-vest CPR was aimed at raising the intra-thoracic pressure by substantially reducing thoracic volume. This was done by exerting a circumferential compression around the lateral as well as anterior sides of the chest. The resulting thoracic compression caused medium-size airways to collapse, trapping air in the lungs. Further compression caused intra-thoracic pressure to rise (by Boyle's law) in proportion to the decrease in thoracic volume.

FIG. 1 shows a CPR recipient receiving CPR by means of a pneumatic-vest as disclosed in the '674 patent along side a recipient receiving manual CPR. For vest CPR, a pneumatic system 10 is provided comprising a vest 12, defibrillators 14, and a pneumatic system controller 16. Vest 12 is fastened to the chest of recipient 18. A cross-sectional view 20 of the recipient's chest is provided, which illustrates compression forces 22 exerted radially inward along various points of the circumference of the chest, including lateral and anterior sides of the chest.

In the case of manual CPR, ECG electrodes 24 are provided coupled to an ECG monitoring device 26. A person administering CPR to recipient 18 will apply a downward force with his or her hands 28 at a single compression point on the chest. The cross-sectional view of the recipient's chest 21 shows the single resulting downward compression force exerted at the central anterior portion of the chest.

According to various studies comparing the CPR techniques illustrated in FIG. 1, the resulting aortic and right-atrial pressure as a result of vest CPR was significantly higher than that produced from manual CPR. Also, the aortic-right-atrial pressure gradient (m Hg) was substantially higher in the case of vest CPR as compared to manual CPR. In addition, short-term survival rates were compared for these two methods of applying CPR. More specifically, in a hemodynamic study, aortic and right-atrial pressures were measured during CPR in 15 patients who failed 42±16 (SD) minutes of manual CPR. Pneumatic-vest CPR increased peak aortic pressure from 78±26 to 138±28 mm Hg ($p<0.001$), and coronary perfusion pressure (aortic-right-atrial pressure) from 15±8 to 23±11 mm Hg ($p<0.003$).

According to the results of the short-term survival study, 34 additional patients (without pressure measurements) were randomized to receive pneumatic-vest CPR or continued manual CPR, after failing initial manual CPR (11±4 minutes). Spontaneous circulation returned in 8/17 pneumatic-vest CPR patients, compared with 3/17 manual CPR patients. However, no patients survived to hospital discharge. This may be because randomized CPR was started late in arrest, which could have been after irreversible organ damage. See Halperin, et al., "A Preliminary Study of Cardiopulmonary Resuscitation by Circumferential Compression of the Chest With Use of a Pneumatic-Vest," New England Journal of Medicine (1993) 329:762-768.

Most cardiac arrests occur outside the hospital, and it is critical that CPR be promptly applied. For these reasons, and others, there is a need for an automated CPR administration system that is easily fastened to a recipient and is easily portable. Existing automated systems, such as the pneumatic vest disclosed in the '674 patent (and commercial versions of the same as provided by Cardiologic Systems) present difficulties in situations outside of the hospital. For example, the pneumatic vest CPR system requires a large inflation console, in order to accommodate the requirements of fluid volume required to sufficiently inflate its bladders. More specifically, the Cardiologic pneumatic-vest CPR system, in order to reduce the volume of the thoracic cavity by 3 to 5 liters, pumps compressed air into the vest bladder. For each inflation, the total air pumped into the vest bladder is 7-10 liters. The inflation console in the Cardiologic system is quite heavy, consumes substantial power, and thus is not practical for mobile environments.

There is a need for an automated CPR device which is easily transported and appropriate for the pre-hospital environment as well as for use within the hospital.

SUMMARY OF THE INVENTION

The present invention is provided to improve upon CPR devices. In order to achieve this end, one or more aspects of the invention may be followed in order to bring about one or more specific objects and advantages, such as those noted below.

One object of the present invention is to provide a CPR device that is mechanized and will consistently administer CPR in a manner that is more effective than standard manual CPR in terms of vital organ perfusion.

A further object of the present invention is to provide such a CPR device which is safe for use in a moving ambulance. The device may be configured so that it will administer CPR to a recipient in an automated fashion, thereby freeing the hands of paramedics.

A further object of the present invention is to provide a CPR device which can be operated with the use of a portable source of energy for at least 15 to 50 minutes. The CPR device will preferably also be capable of use, while transporting a patient on a gurney and in places where a supine position of the patient is impossible.

Further objects include providing a CPR device which will not slide from its correct position on the patient's chest, will take up little space so as to easily clear doors and windows, and will otherwise be light and small to facilitate its portability and operation in various environments.

The present invention, therefore, may be directed to a system for applying CPR to a recipient. The system comprises an automated controller and a compression device. The compression device periodically applies a force to a recipient's thorax under control of the automated controller. The compression device comprises a band, a power mechanism, and a translating mechanism. The band is adapted to be placed around a portion of the torso of the recipient corresponding the recipient's thorax. The power mechanism shortens and lengthens the circumference of the band. By shortening the circumference of the band, radial forces are created acting on at least lateral and anterior portions of the thorax. The translating mechanism translates the radial forces to increase the concentration of the radial forces acting on the anterior portion of the thorax. The power mechanism comprises a tension device for applying a circumferential tensile force to the band.

The driver mechanism may comprise an electric motor or a pneumatic linear actuator. Alternatively, the driver mechanism may comprise a contracting mechanism defining certain portions of the circumference of the band.

More specifically, the driver mechanism may comprise a contracting portion of the band which comprises a contracting mechanism, which, when activated, contracts to thereby shorten the circumference of the band. The contracting portion of the band may comprise plural contracting portions distributed along certain portions of the circumference of the band. The contracting portion may have plural fluid-receiving cells linked together, where the width of each fluid-receiving cell in the direction of the band's circumference becomes smaller as each fluid-receiving cell is filled with a fluid.

The driver mechanism may be further provided with a fluid source and a valve operable under control of the automated controller to periodically fill the plural fluid-receiving cells with fluid from the fluid source. The fluid may comprise a gas substance such as air.

The translating mechanism of the CPR device may comprise a moldable cushion laterally spanning at least a substantial portion of the entire anterior portion of the recipient's chest when positioned between the band and the interior chest. The moldable cushion may comprise a fluid-like substance encased in a casing having dimensions so as to cover at least a substantial portion of the recipient's thorax. The fluid-like substance may comprise a liquid, such as water. It may comprise solid particles, or it may comprise a gas such as air. In the event the fluid-like substance comprises a gas, such as air, the casing may comprise a pneumatic connector for receiving the gas from a gas source.

BRIEF DESCRIPTION OF THE DRAWINGS

The above and other objects, features, and advantages of the present invention are further described in the detailed description which follows, with reference to the drawings by way of non-limiting exemplary embodiments of the present invention, wherein like reference numerals represent similar parts of the present invention throughout the several views and wherein.

DETAILED DESCRIPTION OF THE EXEMPLARY EMBODIMENTS

Figure 2:
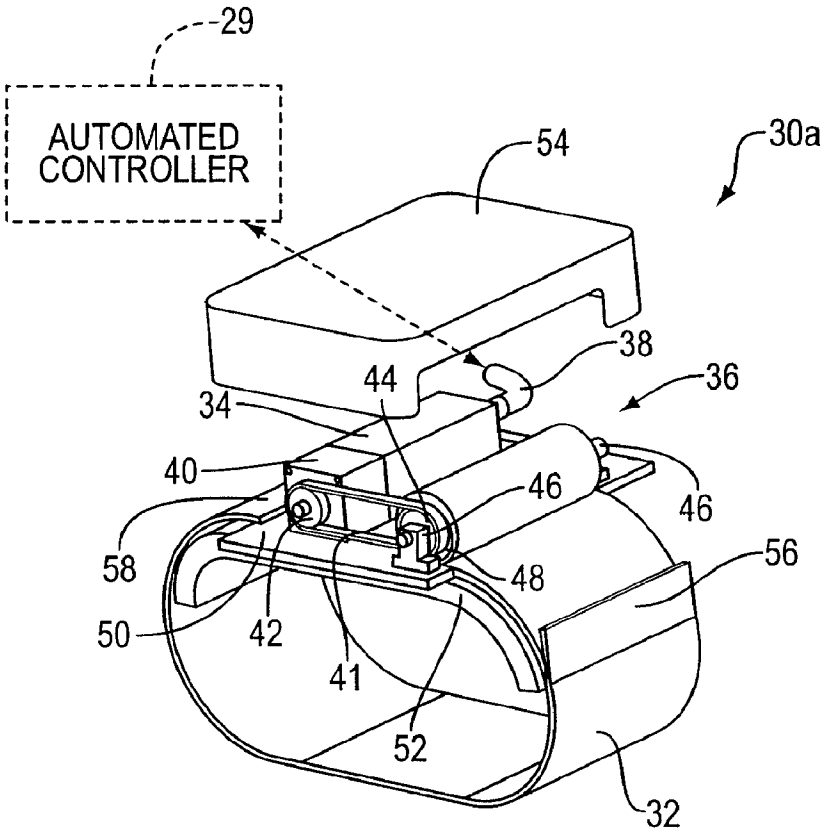
FIG. 2 is a perspective view of a CPR device in accordance with a first embodiment of the present invention.

Referring now to the drawings in greater detail, FIG. 2 shows a CPR device in accordance with a first embodiment of the present invention. The illustrated CPR device comprises an automated controller 29 and a compression device 30*a* for periodically applying a force to a recipient's thorax under control of automatic controller 29. The illustrated compression device 30*a* comprises a band 32 adapted to be placed around a portion of the torso of the recipient corresponding to the recipient's thorax. A driving sub-system 36 is provided which comprises a driver mechanism for shortening and lengthening the circumference of the band. By shortening the circumference of band 32, radial forces are created acting on at least lateral and anterior portions of the thorax of the recipient.

In the illustrated embodiment of FIG. 2, the driver mechanism comprises a motorized system. A motor 34 is connected to a gear reducer 40 comprising an output shaft which drives a drive gear 42. Drive gear 42 is coupled to a translation gear 44 via a chain 41. The translation gear 44 is fixed to a longitudinal shaft of a cylinder 48. The longitudinal shaft is movably attached at each end to a bearing 46. Power and control connections are provided to motor 34 via a cable 38. The entire motor assembly is fixed to a base mount 50.

Band 32 comprises a first end 58 which is fixed to a first side of base mount 50, and a second end secured to cylinder 48 so that rotation of cylinder 48 will cause band 32 to be wound and thereby shortened, or to be unwound and thereby lengthened. Band 32 can be unfastened and placed around the chest portion of the torso of a recipient and refastened at fastening portion 56. Fastening portion 56 may comprise, for example, a hook and loop connecting mechanism such as VELCRO®.

A translating mechanism, comprising moldable cushion 52, is provided for translating the radial forces acting on the torso of the recipient to create an increased concentration of anterior radial forces acting on the anterior portion of the recipient's thorax. This portion corresponds to the upper portion of band 32 and the position at which moldable cushion 52 is located. Moldable cushion 52 preferably comprise a member having non-compressible fluid-like properties so that it will mold to the varying surfaces covering the recipient's chest as well as accommodate the changing circumference and shape of band 32, without dampening the compression forces applied by compression device 30*a*. In the first embodiment compression device 30*a*, moldable cushion 52 comprises a hydraulic bladder.

The illustrated first embodiment compression device 30*a* further comprises a cover 54 for covering the various mechanisms. Cover 54 is provided not only for aesthetic reasons but also for safety reasons, to reduce the risk of an injury that might occur as a result of contact with the moving mechanisms of the compression device.

Figure 1:
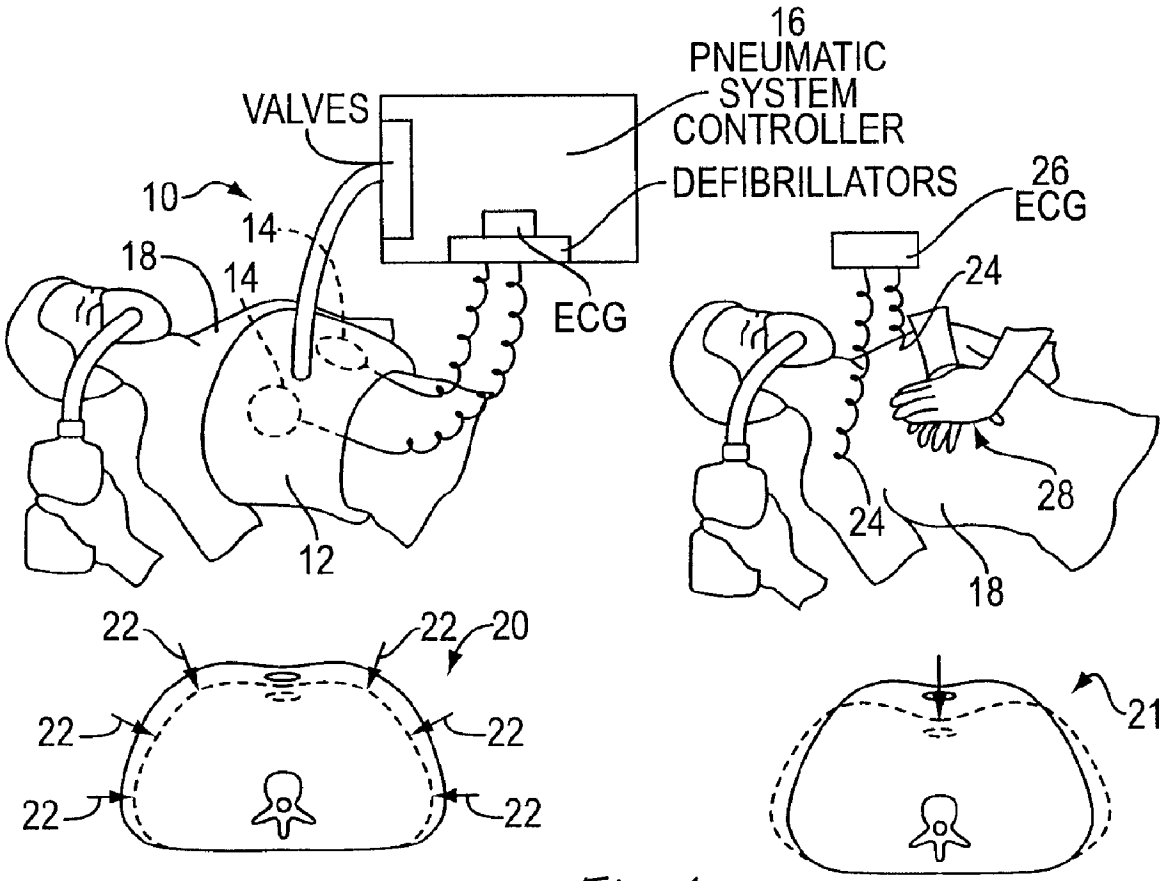
FIG. 1 shows the administration of CPR to a recipient using two known techniques.
Figure 3:
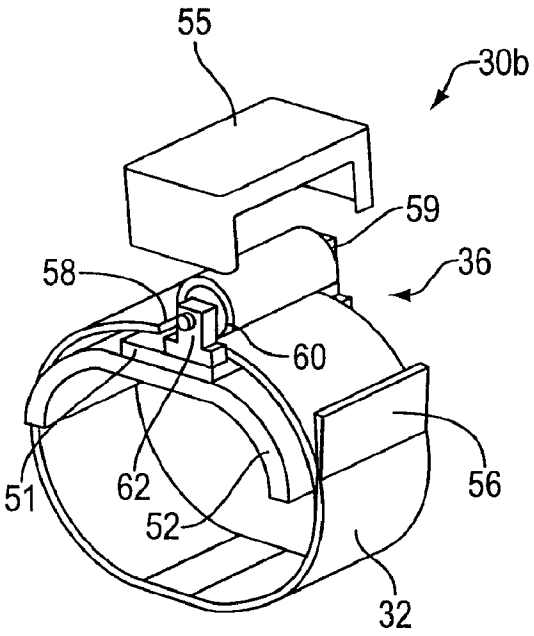
FIG. 3 is a perspective view of a CPR device in accordance with a second embodiment of the present invention.

FIG. 3 shows a second embodiment CPR device comprising a compression device 30*b*. In this embodiment, the cylinder is configured to be concentric with the electric motor, making the resulting device more compact and reducing the need for extra components such as a chain drive mechanism as was provided in the first embodiment shown in FIG. 2.

The illustrated compression device 30*b* comprises a motor 59 which drives and is concentric with a cylinder 60 movably fixed to a base mount 51 by means of a bearing 62. A band 32 is provided having a first end 58 fixed to a first side of base mount 51, and a second end secured to cylinder 60. Accordingly, when cylinder 60 is rotated by motor 59, it may either wind or unwind band 32, causing the band 32 to be shortened or lengthened, respectively. When band 32 is shortened, radial forces are created which act on at least lateral and anterior portions of the recipient's thorax. When band 32 is lengthened, this force is released. A translation mechanism comprising a moldable cushion 52 is provided to translate the radial forces to create an increased concentration of anterior radial forces acting on the anterior portion of the thorax.

The illustrated moldable cushion 52 may be configured as described above with reference to the first embodiment shown in FIG. 2. Similarly, band 32 may comprise a fastening portion 56 as described above with respect to the embodiment of FIG. 2. A cover 55 may be provided for aesthetic reasons as well as to protect users of the device from injury as a result of the moving parts of the driver mechanism.

Figure 4:
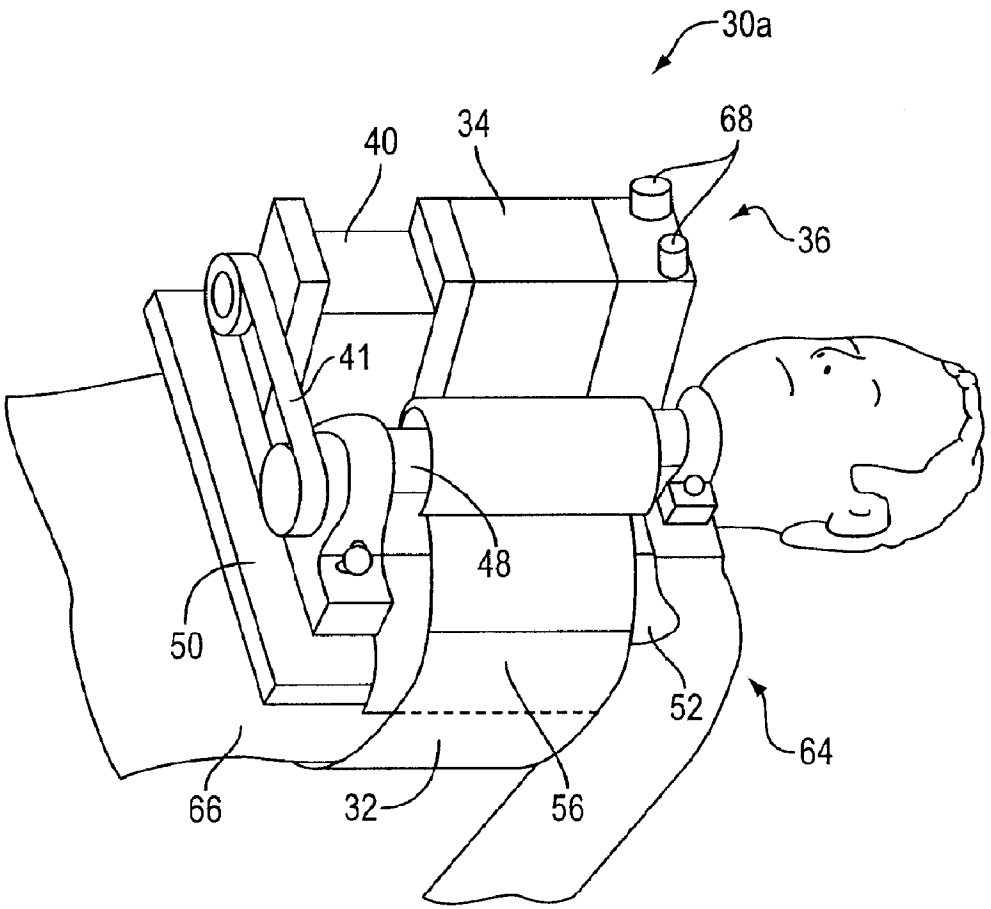
FIG. 4 is a perspective view of the CPR device of FIG. 2 being applied to a CPR recipient.

FIG. 4 shows the compression device 30*a* of the first embodiment CPR device fastened to a recipient 64. In operation, moldable cushion 52 is first placed on the chest of recipient 64. Compression device 30*a* is then fastened to torso 66 of recipient 64. Base mount 50 is placed on the recipient's chest and band 32 is wrapped across the right side of the chest and around the recipient's back. Belt 32 is fastened via a fastening portion 56 to a portion of band 32 secured to cylinder 48. Control and power cables are then coupled to the driver mechanism 36 via cable connects 68.

More specifically, the band is fastened via a fastening portion 56 while it is in a relaxed position. Motor 34 is then actuated to rotate cylinder 48 to specify an initial compression force. An automated controller controls the motor to wind and unwind band 32 in order to create forces periodically applied to the recipient's thorax per desired CPR parameters. That is, motor 34 is controlled in such a manner to cause a desired displacement of the chest portion of the thorax downward toward the spine for a desired duration, and to allow the chest portion of the thorax to return to its initial position by unwinding of band 32 for another specified duration. These compressions and decompressions are repeated periodically at a certain frequency.

In the illustrated second embodiment shown in FIGS. 2 and 4, moldable cushion 52 comprises a water-containing bladder (a hydraulic cushion) placed between band 32 and the anterior portion of the recipient's chest. Motor 34 drives chain 41 through gear reducer 40. Chain 41 then drives cylinder 48 which tightens and loosens the circumferential band 32. A cover is not shown in FIG. 4 in order to show the details of construction in the illustrated embodiment. A band guard (not shown) may be provided which prevents objects such as clothing from being drawn into the mechanism.

By shortening and lengthening the circumference of band 32, a chest compression force is applied and released. Moldable cushion 52 helps translate the radial forces created on the thorax of recipient 64 to create an increased concentration of anterior radial forces acting on the anterior portion of the thorax of the recipient 64. The length of each compression cycle may be approximately 400 ms. At the end of the compression cycle, the motor is reversed and the band is loosened until no pressure is applied to the chest.

A pressure sensor may be provided for measuring the pressure applied to the recipient's chest. Alternatively, a chest compression monitor may be used together with the illustrated compression device 30*a* (provided integrally or separately) for providing an indication of the displacement of the chest along the direction toward the spine of recipient 64.

A small amount of residual force (bias) can be maintained on the thorax during the release phase of chest compression. By maintaining this bias force, improved efficiency of chest compression has been shown. If such a bias force is used, it is recommended that the bias force be fully released every several (e.g., five) cycles to allow for a full chest expansion for ventilation.

Motor 34 of the first embodiment and motor 59 of the second embodiment may each comprise a brushless DC motor (e.g., model BM-200, Aerotech Pittsburgh, Pa.). The peak tensile force applied to band 32 in the first and second embodiments shown in FIGS. 2-4 is approximately 300 lbs. (140 kg), and the maximum travel of band 32 for tightening is between 2 and 3 inches. Accordingly, to take into account reserve capacity, the expected range of belt travel is up to approximately 4 inches. In order to achieve 140 kg force with an amount of roller travel of 4 inches in 250 milliseconds, the motor should be capable of achieving a motor acceleration of 4520 rad/sec$^2$, and a speed of 3,600 RPM (using a triangular acceleration/deceleration profile) and a torque of 450 oz-in (using a 20:1 speed reducer). The speed reducer acts as a torque multiplier. Per these specifications, the peak expected power consumption of the motor would be approximately 600 Watts, and the average power consumption would be on the order of 300 Watts.

The compression devices 30*a* and 30*b* shown in FIGS. 2 and 3 may be provided with a portable energy source to facilitate the portability of the CPR system. Preferably, such a portable energy source would provide at least 20 minutes of operation time. In the illustrated embodiment, a battery of electrode-chemical form is provided in order to accommodate 200 or more compression/decompression cycles, an average expected power rate of 300 Watts, a calendar life of greater than 2 years and a weight of 7.5 kg or less. Per the illustrated embodiment, a 24 Volt battery is utilized. With a power consumption of 300 Watts, such a battery will create a resulting discharge current of 12.5 A, and when accommodating peak power requirements, the discharge current will reach 25 A.

A power converter may be provided for converting the 24 volt output of the battery to 250-300 volts. By providing a high DC voltage (250-300 volts), a motor which is more compact, lighter, and more efficient in its use of power can be utilized.

The battery may comprise Lithium-Ion or Nickel-Metal-Hydride, which each provide a very high density. Alternatively, the battery may comprise Nickel-Cadmium (NiCd) batteries commonly used in power tools and medical equipment, which are relatively robust, can sustain high discharge currents, and are available in various commercial packages. Sealed Lead-Acid (SLA) batteries provide a high power density, are reliable, are easy to recycle, and are safe. For example, two standard 5 Ah 12.0V SLA batteries from Panasonic can be utilized. Such batteries would provide at room temperature 12 minutes of operation of the CPR device of the first and second embodiments and a minimum of 9 minutes at 0° C. 8 or 10 Ah nominal batteries would provide 20-24 minutes of operation for the illustrated compression devices.

Thin metal film (TMF) batteries may be utilized as well. These batteries utilize an increased plate surface area within the battery. A short conduction path through the active material to the plates enables them to achieve energy and power-density typical of advanced NiCd systems. By using a thin foil, the electrode surface area is significantly increased. This lowers the impedance of the cell and increases the rate at which it can be charged and discharged.

Preferably, the illustrated CPR device, comprising a compression device 30*a* or 30*b* and an automated controller 29, will operate not only by means of its internal battery but also from power provided by U.S. mains (115±15 VAC, 60 Hz) or European mains (230±23 VAC, 50 Hz). A power conversion mechanism should also be provided to allow operation from ambulance invertors. Power electronics may be provided which include a high power factor, low conducted and emitted EMI which will meet international standards for home use, low leakage currents in order to meet medical safety standards, a high energy density in order to reduce the weight of the device, and a robust thermal design so that the device will operate under a variety of environmental conditions. Many off-the-shelf devices are available which will satisfy these parameters. For example, power electronic devices from Lambda and Vicor may be utilized. Standard front/end and DC/DC converter solutions may be utilized.

Figure 5:
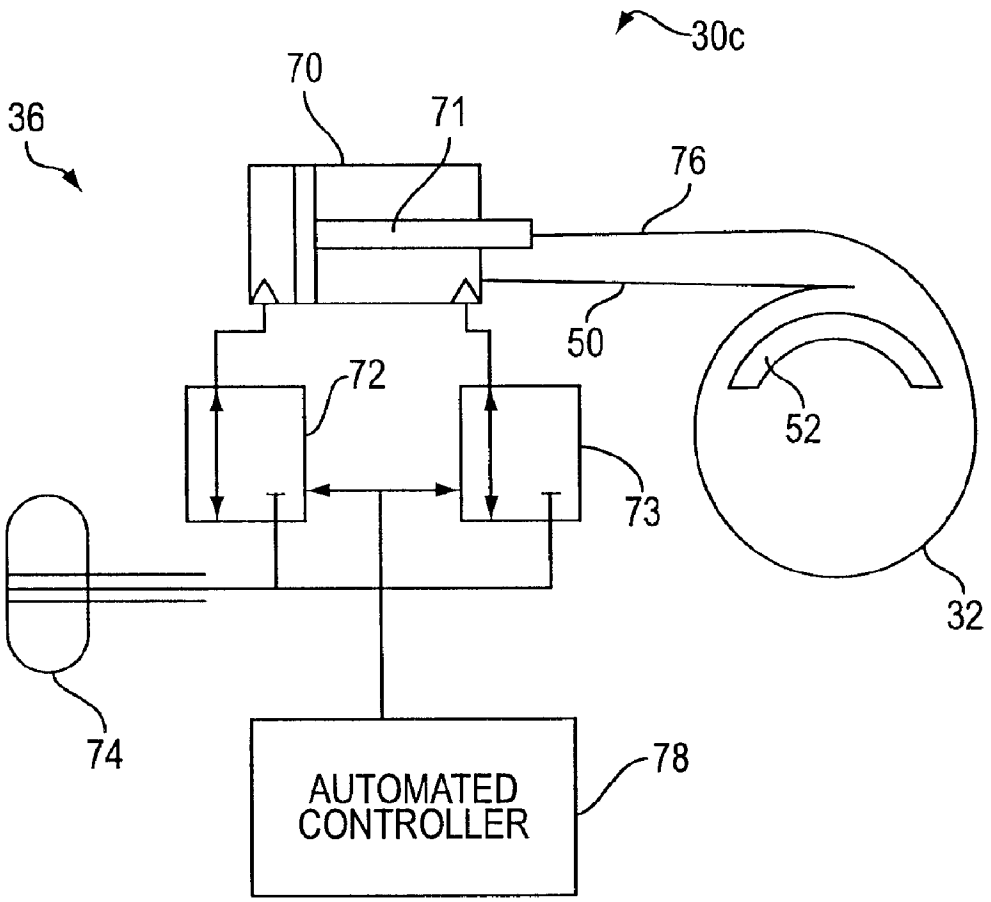
FIG. 5 is a schematic diagram of a CPR device in accordance with a third embodiment of the present invention.

FIG. 5 is a schematic diagram of a third embodiment compression device 30*c* which utilizes a pneumatically actuated band. A driving subsystem 36 is provided which comprises a pneumatic actuator 70 coupled to a lengthening valve 72 and a shortening valve 73. An air source 74 provides air to each of the valves 72 and 73. An automated controller 78 is provided which controls the operation of lengthening valve 72 and shortening valve 73. Pneumatic actuator 70 comprises a piston 71 connected to a gripping member 76 which grips one end of a flexible band 32 which will be wrapped around the chest portion of the torso of a CPR recipient. The other end of band 32 is fixed to a base mount 50 which is provided as a support for such components as the pneumatic actuator 70. Like the first and second embodiments, compression device 30*c* further comprises a moldable cushion 52. In this particular embodiment, moldable cushion 52 comprises a hydraulic cushion implemented in the form of a water-containing bladder.

During operation of the system illustrated in FIG. 5, flexible band 32 is fastened around the torso of the CPR recipient and initially relaxed. Then, upon starting of CPR under control of automated controller 78, band 32 is tightened and loosened by air pressure being applied alternately to either side of piston 71 of pneumatic actuator 70. The resulting circumferential tensile force applied to band 32 creates radial forces acting on at least the lateral and anterior portions of the CPR recipient's thorax. Some of these forces are translated by compressible cushion 52 which is placed between upper portions of band 32 and the entire anterior chest of the CPR recipient. More specifically, the forces applied by band 32 translate into radial forces being applied to the top portion of moldable cushion 52 which then translates those forces into inward radial forces acting predominately upon the anterior portion of the CPR recipient's chest and thorax, with some forces continuing to act on the lateral sides of the thorax as well.

A pressure sensor or displacement sensing device may be provided which indicates the pressure being applied to the CPR recipient's chest or indicates the displacement of the chest in relation to the spine as a result of the applied compressions. Accordingly, automated controller 78 can control the loosening and tightening of band 32 depending upon the force indicated by the pressure sensor (or the displacement indicated by the displacement sensor) in order to control the compression cycles to be of a certain duration and the release cycles to be of another preset duration. Automated controller 78 tightens/shortens the circumference of band 32 by activating shortening valve 32 to release air into the right side chamber of pneumatic actuator 70, causing piston 71 to move to the left. When band 32 is lengthened, shortening valve 32 is deactivated and lengthening valve 72 is activated to cause air to be released into the left side chamber of pneumatic actuator 70, causing piston 71 to move to the right. This cycle is repeated in order to apply periodic compression and depression forces to moldable cushion 52 which will translate those forces to radially inward forces applied predominately to the anterior portion of the CPR recipient's thorax.

Figure 6:
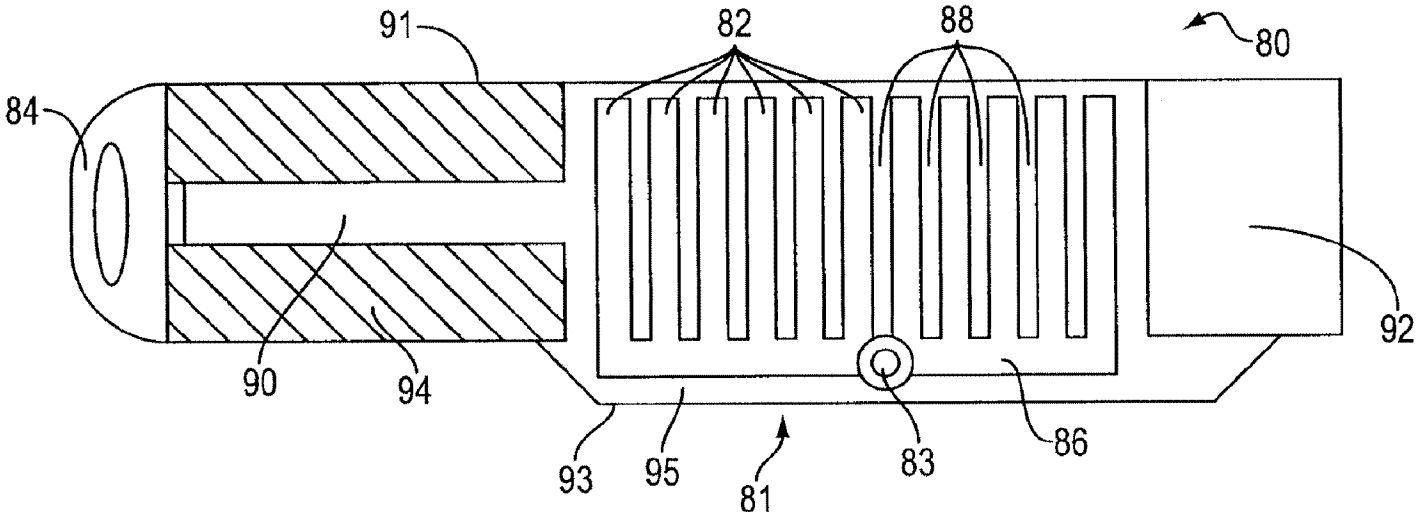
FIG. 6 is a top view of a band to be used in a fourth embodiment CPR device.

FIG. 6 shows a band 80 provided in accordance with a forth embodiment compression device of the present invention. Band 80 comprises a pneumatically operated constricting band. Band 80 comprises at a first end a grip 84 having an opening for receiving the hand of personnel applying and fastening the band to a CPR recipient. Also at the first end, a first reinforced fastening portion 90 is provided. At the opposite second end, a second reinforced fastening portion 92 is provided. In the illustrated embodiment, first and second reinforced fastening portions comprise complimentary hook and loop fastening mechanisms (such as VELCRO®).

A plurality of parallel fluid-receiving cells 82 are distributed in the longitudinal direction along a central portion of band 80, and are separated (and connected) by linking portions 88. Each fluid-receiving cell 82 is coupled to a common manifold 86, which comprises a connector 83 for receiving air from an actuation valve.

Band 80, when in its uninflated state, comprise a substantially web-like configuration, and serves as a wide belt or strap to be wrapped around the torso of the CPR recipient. The side of band 80 which is viewable in FIG. 6 is opposite the side which will come into contact with the CPR recipient's torso. The illustrated Band 80 comprises a first side 91 and an opposing second side 93. When fastened to a recipient, first side 91 is positioned toward the recipient's upper chest area. Second side 93 comprises a widening portion 95 for facilitating the compression of portions of the thorax near the abdomen. First reinforced fastening portion 90 comprises a hook or loop configuration which is formed over a substantial area of the viewable side of band 80. The opposing second reinforced fastening portion 92 comprises on the opposite, contacting side of band 80 a complimentary hook or loop configuration (not shown) which will compliment and receive hook or loop portion 94 in a manner to securely fasten band 80 around the CPR recipient's torso.

Band 80 comprises a central portion 81 at which fluid-receiving cells 82 and linking portions 88 are distributed along the longitudinal direction of band 80 (which corresponds to the circumference of band 80 when it is fastened to a CPR recipient). Central portion 81 has a width which is slightly larger than the width of band 80 at the first and second end portions.

The illustrated band 80 may be formed from two pieces of urethane-coated nylon fabric. The urethane may be heat-sealed to form a pattern of air cells, 82 as shown connected to a common manifold 86. Band 80 is fastened around the chest using the hook and loop fasteners provided at first and second reinforced fastening portions 90 and 92.

Figure 7:
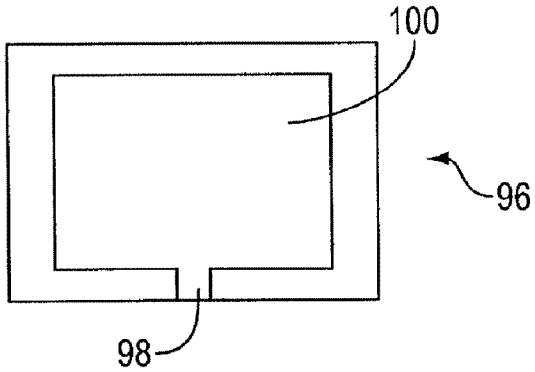
FIG. 7 is a top view of a pneumatic cushion.

FIG. 7 shows a moldable cushion 96 comprising a fluid receiving connector 98 and a fluid-receiving chamber 100. In the illustrated embodiment, air is pumped into cushion 96 by means of fluid-receiving connector 98. Alternatively, liquid may be pumped into cushion 96, or cushion 96 may comprise a permanently-sealed chamber holding, a fluid such as air or liquid. In the illustrated embodiment, moldable cushion 96 is also formed with two pieces of urethane-coated nylon fabric heat-sealed to form a pattern as illustrated in FIG. 7, with the resulting fluid-receiving chamber 100. Moldable cushion 96 is attached to band 80 so that when band 80 is fastened around the chest, the cushion will be between the anterior portion of the chest and band 80.

Figure 8:
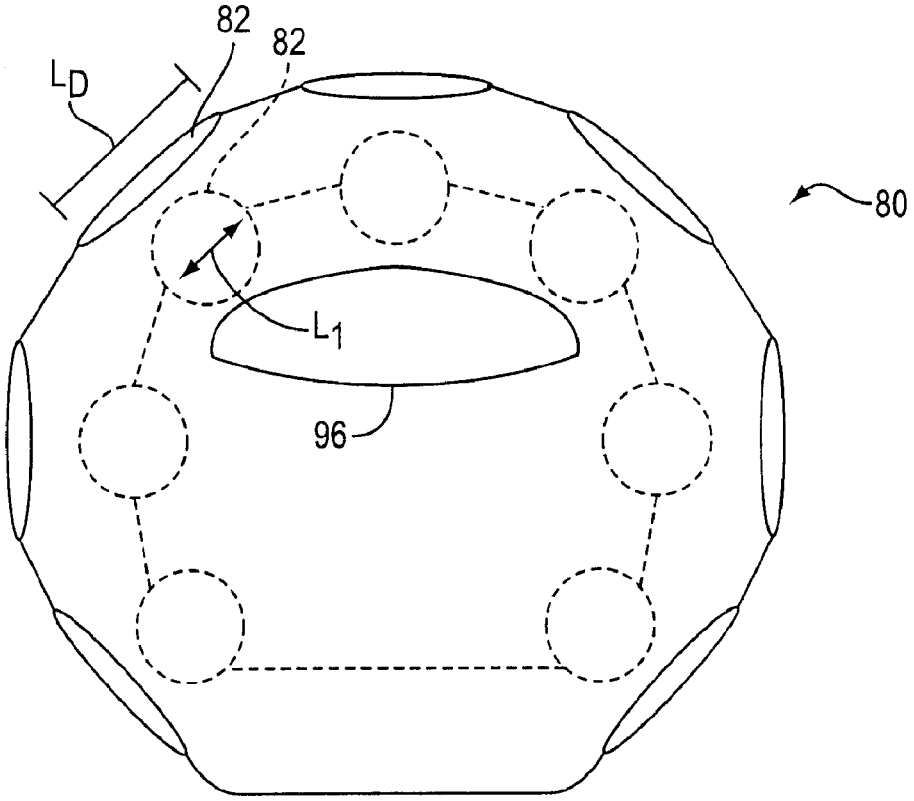
FIG. 8 is a simplified schematic view of the fourth embodiment CPR device being administered to a recipient.

FIG. 8 shows in a schematic diagram a cross section of band 80 in its fastened state in relation to a moldable cushion 96, when band 80 is in its deflated and inflated states. As shown in FIG. 8, when band 80 is not inflated, the width $L_D$ of each fluid-receiving cell 82 is larger than its width $L_1$ when band 80 is inflated, i.e., each cell 82 has been filled with a fluid. This causes a contraction of band 80 and a resulting shortening of the circumference of band 80. Fluid receiving cells 82 form a contracting mechanism which, when activated, contracts to thereby shorten the circumference of band 80. More specifically, fluid-receiving cells 82 serve as plural contracting portions of band 80 which are distributed along certain portions of the circumference of band 80. When each of the fluid-receiving cells is filled with a fluid, their respective widths become smaller.

In the illustrated embodiment shown in FIGS. 6-9, the fluid used to fill each fluid-receiving cell comprises air. Other appropriate fluid substances can be used as well, even liquids such as water.

Referring back to FIG. 8, when the fluid-receiving cells 82 are deflated (solid lines), band 90 has a larger circumference and the chest is not compressed. When fluid-receiving cells 82 are inflated (dashed lines), band 80 has a smaller circumference and the chest is compressed. The amount of compression created by the band is determined by the ratio of the deflated to inflated circumferences. If the deflated width of each fluid-receiving cell is $L_D$, then the deflated circumference of an individual fluid-receiving cell is $2L_D$. When the cells are inflated, the circumference is still $2L_D$, but the widths of each fluid-receiving cell is the circumference divided by $\pi$, since $\pi$ times the diameter is the circumference. Thus, the inflated width is $2/\pi \times$the deflated width, or a reduction in the width of $1-2/\pi=1-0.64=0.36$, or 36%. Thus, inflating all the cells results in a reduction in the circumference equal to 36% of the portion of the band containing the cells. If 30 cm of the band is provided with air cells, the amount of reduction in circumference in the band would be 0.36 (30)=11 cm.

Preliminary studies with a band driven by a linear pneumatic actuator as shown in FIG. 5 indicated that a circumference reduction in the amount of 8 cm in a 90 kg pig was sufficient to generate an aortic peak pressure of at least 120 mm Hg. In addition to chest compression from the restricting band itself, chest compression can be further augmented by placing a cushion such as a moldable cushion 96 between the upper part of the band and the anterior chest of the CPR recipient. The cushion helps translate forces created by the band to create a concentration of radial forces primarily at the anterior portion of the chest which are then translated to an anterior force acting on the thorax of the CPR recipient.

By providing a pneumatic moldable cushion 96 which is inflated in conjunction with the inflation of fluid-receiving cells 82, moldable cushion 96 can apply additional inward force to enhance the resulting increase in intra-thoracic pressure caused by the chest compressions. The pneumatic cushion would require substantially less air than the pneumatic band, since the pneumatic cushion is passive and expands outwardly during inflation. To optimize air consumption and provide desired chest compressions while minimizing trauma, the rate of inflation (cycles per minute) and the length of inflation in each cycle (the duty cycle) may be different for the band than for pneumatic moldable cushion 96. For example, the band may be constricted at a rate of 20 cycles per minute, while the cushion is constricted at a rate of 60 cycles per minute. In this case, the constricted state for each inflation cycle of the band may maintained for three compression cycles of moldable cushion 96, so the resulting compressions of the thorax will result in a desired displacement of the thorax at a rate of 60 compressions per minute.

In the illustrated embodiment, band 80 comprises 12 air cells, each having a deflated width of 1 inch. Each of the cells is 7 inches in length, and is separated by a distance along the longitudinal axis of band 80 of 0.5 inches. The radius of an inflated cell is:

$$R=2\times(Ld)/2\pi=2(1)/(6.28)=0.32 \text{ in}$$

Inflated air cell area is:

$$A=\pi(R)^2=3.14\times(0.32)^2=0.32 \text{ sqin}$$

The total area to inflate is 12 times the area of one cell, which is equal to:

$$A_{tot}=12\times A=12\times 0.32=3.8 \text{ sqin}$$

The total volume of the inflated air cells is the area times the length, which is equal to:

$$V=S\times A=7\times 3.8=27 \text{ cuin}$$

Since gases are compressible, it is convenient to perform volumetric calculations in standard units. Standard units correspond to the equivalent volume of air at standard atmospheric pressure: $P_a$=14.69 psi. In standard units, the volume of gas ($V_a$) needed to inflate the air cells at operational pressure P (20 psi) is equal to:

$$V_a=V\times(P_a+P)/P_a=-27(14.69+20)/14.69=64 \text{ cuin}$$

Assuming the band is inflated to full pressure (20 psi) for every chest compression this allows calculation of standard air flow rate $F_a$ at a given chest compression rate R in beats per minute. If the compression rate is equal to 60/minute:

$$F_a=V_a\times R=64\times 60=3{,}840 \text{ cuin/min}$$

For the pneumatic cushion, we assume the volume of the cushion is 0.5 liter, and it is inflated to 5 psi. The additional air consumption (using similar calculations as above) would be:

$$F_a=V_a\times R=42\times 60=2{,}520 \text{ cuin/min}$$

Thus, the total air consumption would be 6,360 cuin/min.

Figure 9:
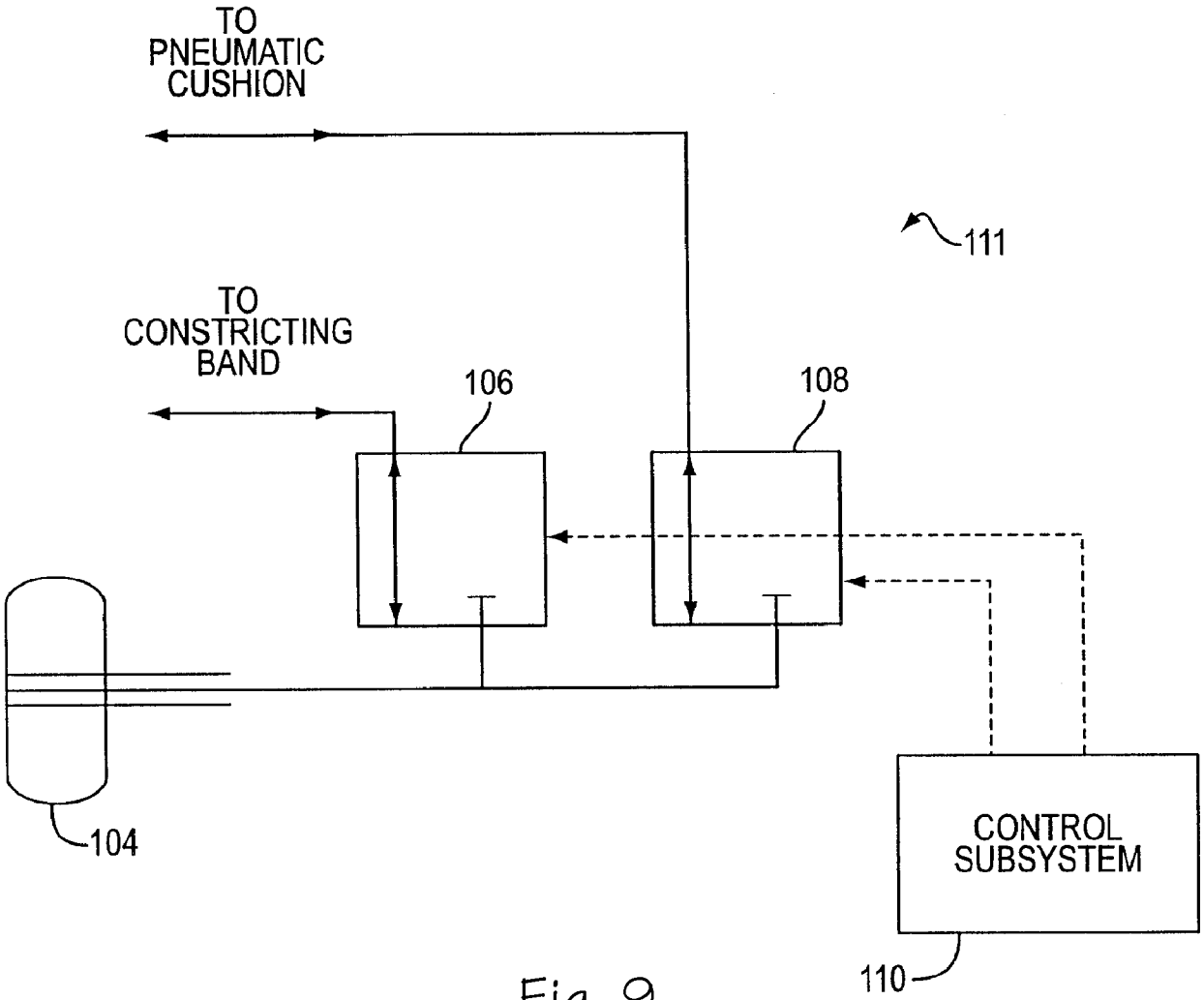
FIG. 9 is a schematic diagram of a driving system and automated control sub-system which may be provided in association with the band and pneumatic cushion of the fourth embodiment CPR device.

FIG. 9 shows a control subsystem 110 together with a driving subsystem 111 which can be utilized in connection with the band 80 and moldable cushion 96 illustrated in FIGS. 6-8, to form an overall system for applying CPR to a recipient. As shown, the inflation and deflation of each of moldable cushion 96 and band 80 can be controlled by respective valves 108 and 106. An air source 104 is connected to each of valves 106 and 108, and the actuation of those valves is controlled by subsystem 110.

Each of valves 106 and 108 may be provided with integral flow regulators. Each flow regulator will allow control of the speed of pressurized chest compressions. Control subsystem 110 controls the compressions so that full compression of the chest is achieved in 100-200 ms for efficient CPR. Compression that is too fast can cause trauma, and compression that is too slow can reduce effectiveness. Integrally provided flow regulators, which help control this compression, may comprise calibrated adjustable orifices.

Each of valves 106 and 108 may comprise commercially available solenoid valves. Many commercially available solenoid valves having a dimension of 0.25-0.5 inches, which is required for flow capacity, and have a response time of less than 50 ms. Solenoid operators used to actuate such valves typically operate from 12-24 VDC and consume between 16 and 31 Watts of power.

A pressure regulator (not shown) can be used to control the force of applied chest compressions.

Alternatively, a pneumatically-operated device could be constructed so that no electric power will be required to power valves 106 and 108. Such a non-electrical system provides advantages including simplicity of operation, safety in explosive environments, and zero electro-magnetic interference. Fluidic circuits may be provided which control timing and sequencing of the operations of valves 106 and 108. Appropriate components may be provided in the form of fluid circuits to assimilate delays for example, by using calibrated resistors (orifices) and pneumatic (volume buffer) capacitors. Pneumatic relays may be provided that open and close the control valves when pressure builds up to a preset level. These components can be combined to create a simple timing circuit. Instead of solenoids, small pneumatic pilot valves may be used to open and close the main control valves.

Air source 104 will preferably be capable of providing 6,360 cuin/min. of air. This will allow 60 compressions per minute for a minimum time of 20 minutes.

$$Q_a=F_a\times 20=6{,}360\times 20=127{,}200 \text{ cuin}$$

More specifically, air source 104 may comprise a standard compressed gas (air or oxygen) source that is readily available to paramedics and fire fighters. Such a source may comprise the type of compressed oxygen cylinders normally carried by emergency personnel for patient ventilation. A typical pressure used in such commercial cylinders is at least $P_c$=2,500 psi. The volume of compressed gas required can be calculated from standard air volume using Boil's law.

$$Q=Q_a(P_a)/(P_a+P_c)=127{,}200(14.69)/(14.69+2{,}500)=743 \text{ cuin}=12 \text{ liters}$$

Therefore, the illustrated embodiment comprises an air source 104 having a total volume ability of 12 liters, which will allow operation of the illustrated device for 20 minutes at maximum pressure. One example of a cylinder air source is that provided by Structural Composite Industries which has a volume of 9.0 liters and weighs 8 kg. Cylinders of this type are charged to 4,500 psi, and may operate the illustrated system for between 15 and 20 minutes depending upon operating pressure.

Air source 104 may alternatively comprise a power operated compressor air source. Such air sources can be conveniently powered from AC mains, as well as batteries. However, they have an increased cost and complexity. A compressor air source typically requires at least a compressor and motor. The compressor may comprise a rotary vein compressor which produces pressures of 20-25 PSI at a flow rate of 10,000 cuin/min. One example of a rotary vein compressor that could be used is that provided by Parker, Airborne, Model IOV 1-2. The motor to drive such a compressor may consume on the order of 400 Watts of electric power. Such a motor may comprise, for example, a brushless DC motor such as model BM-200, Aerotech, Pittsburgh, Pa. This motor weighs only 1.5 kg.

A battery that may be provided for powering the air compressor may be in the form of a 24V battery capable of handling resulting discharge currents of 13 A, and capable of being converted with a power converter to 250-300V.

Each of the illustrated CPR devices may be configured so that it is capable of operating from AC when available. The motor used to power the compressor, or other components as disclosed in the other embodiments—e.g., as shown in FIGS. 2 and 3—may present a capacitative load to an AC power source. Such a load will distort the AC current waveform and introduce higher harmonics that are out of phase with AC voltage. As a result, more power will be drawn from the source than is actually used to spin the motor. Other critical emergency equipment, such as suction pumps and ECG monitors may be operated from the same AC power source as the CPR device, in various environments such as an ambulance. It is customary to insure a 20% safety margin on the line current. Accordingly, the power factor of the CPR device disclosed herein should be greater than 0.95, which requires a power factor correction circuit provided at the front end of the device. In this regard, an LC (inductor plus capacitor) filter may be provided to form a passive circuit, or alternatively an active circuit comprising a switching circuit using FET switches and a control circuit based upon an industry standard IC may be utilized.

The CPR device in each of the embodiments disclosed herein may be used in conjunction with a chest compression monitor device such as that disclosed in commonly assigned U.S. patent application filed in the names of Halperin et al. on even date herewith, entitled "CPR Chest Compression Monitor," the content of which is hereby expressly incorporated herein by reference in its entirety.

While the invention has been described by way of exemplary embodiments, it is understood that the words which have been used herein are words of description, rather than words of limitation. Changes may be made, within the purview of the appended claims, without departing from the scope of the invention in its various aspects. Although the invention has been described herein with reference to particular structures, materials, and embodiments, it is understood that the invention is not necessarily limited to those particulars. The invention may extend to various equivalent structures, mechanisms, and uses.

What is claimed is:

1. A method of compressing the chest of a patient during cardiopulmonary resuscitation, wherein the chest is characterized by the sternum of the patient and areas lateral to the sternum, said method comprising the steps of:

providing a device for compressing the chest of a patient, said device comprising:

a band adapted to extend around the chest of the patient;

a plurality of fluid receiving cells disposed along the length of the band;

an inflation mechanism, operably connected to the fluid receiving cells, for inflating and deflating the cells to contract the band;

a fluid-filled bladder disposed between the chest of the patient and the band, with at least a portion of said fluid-filled bladder disposed over the sternum of the patient; and an automated controller for controlling operation of the inflation mechanism;

wherein the controller is programmed to control the inflation mechanism to simultaneously inflate and deflate the fluid receiving cells at a rate sufficient to perform cardiopulmonary resuscitation;

wherein the controller is programmed to simultaneously inflate the fluid receiving cells to a tightness sufficient to perform cardiopulmonary resuscitation;

placing the bladder on the anterior portion of the chest of the patient such that the fluid-filled bladder substantially covers the sternum of the patient;

securing the band around the chest of the patient and over the bladder; and operating the device to simultaneously inflate and deflate the fluid receiving cells to alternately compress and release the chest of the patient in alternating compression and release phases at a rate sufficient to perform cardiopulmonary resuscitation on the patient where the compression phase achieves a tightness sufficient to perform cardiopulmonary resuscitation on the patient.

2. The method of claim 1 further comprising the step of maintaining a small amount of residual force against the patient's sternum during the release phase.

3. The method of claim 2 further comprising the step of fully releasing the small amount of residual force periodically.

4. The method of claim 2 further comprising the step of fully releasing the small amount of residual force every 5 cycles.

5. The method of claim 1 wherein the fluid-filled bladder is filled with a liquid.

6. The method of claim 1 wherein the fluid-filled bladder is filled with a gas.

7. The method of claim 1 wherein the device further comprises a pressure sensor operably coupled to the controller for measuring pressure applied to the patient's chest.

8. The method of claim 1 wherein the device further comprises a battery selected from the group of batteries consisting of Thin Metal Film, Lithium-Ion, Nickel-Cadmium, Sealed Lead-Acid and Nickel-Metal-Hydride batteries.

9. The method of claim 1, wherein the device further comprises a power conversion mechanism adapted to operably couple the device to ambulance invertors.

* * * * *